United States Patent [19]

Dunsworth

[11] Patent Number: 4,557,082

[45] Date of Patent: Dec. 10, 1985

[54] WIDE EXTENSION EXPANSION JOINT ASSEMBLY

[75] Inventor: Charles L. Dunsworth, Midwest City, Okla.

[73] Assignee: Metalines, Inc., Oklahoma City, Okla.

[21] Appl. No.: 611,219

[22] Filed: May 17, 1984

[51] Int. Cl.[4] ..... E04B 1/68; E04F 15/14

[52] U.S. Cl. ..... 52/109; 52/396; 52/573; 52/173 DS; 160/159; 404/47; 404/52

[58] Field of Search ..... 52/109, 173 DS, 470, 52/573, 396, 403, 74; 135/104; 160/159, 147, 342, 161; 404/47, 52, 67-69

[56] References Cited

U.S. PATENT DOCUMENTS

| | | | |
|---|---|---|---|
| 2,544,008 | 3/1951 | Coleman | 160/159 X |
| 3,092,171 | 6/1963 | Deddo | 52/74 X |
| 3,526,066 | 9/1970 | Hagar et al. | 52/109 X |
| 3,648,423 | 3/1972 | Cole | 52/109 |
| 3,797,952 | 3/1974 | Pommerening et al. | 52/573 X |
| 3,850,539 | 11/1974 | Bowman et al. | 404/69 |
| 4,087,191 | 5/1978 | Brady et al. | 404/69 |
| 4,120,066 | 10/1978 | Leroux | 404/69 X |

FOREIGN PATENT DOCUMENTS

| | | | |
|---|---|---|---|
| 1534229 | 4/1970 | Fed. Rep. of Germany | 52/396 |
| 488880 | 5/1970 | Switzerland | 52/396 |

*Primary Examiner*—Donald G. Kelly
*Assistant Examiner*—Richard Chilcot, Jr.
*Attorney, Agent, or Firm*—Robert M. Hessin

[57] ABSTRACT

Apparatus for covering relatively wider building structure expansion voids which includes a cover panel, base member extrusions for opposite side support and a lazy tong centering assembly for both supportive attachment to the cover panel and maintaining proper alignment and relative positioning to said void in tolerance of orthogonal relative displacements between adjacent structures.

19 Claims, 12 Drawing Figures

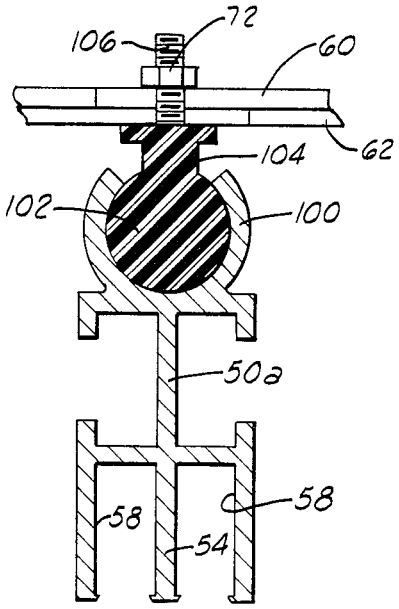
FIG. 3A
FIG. 3B
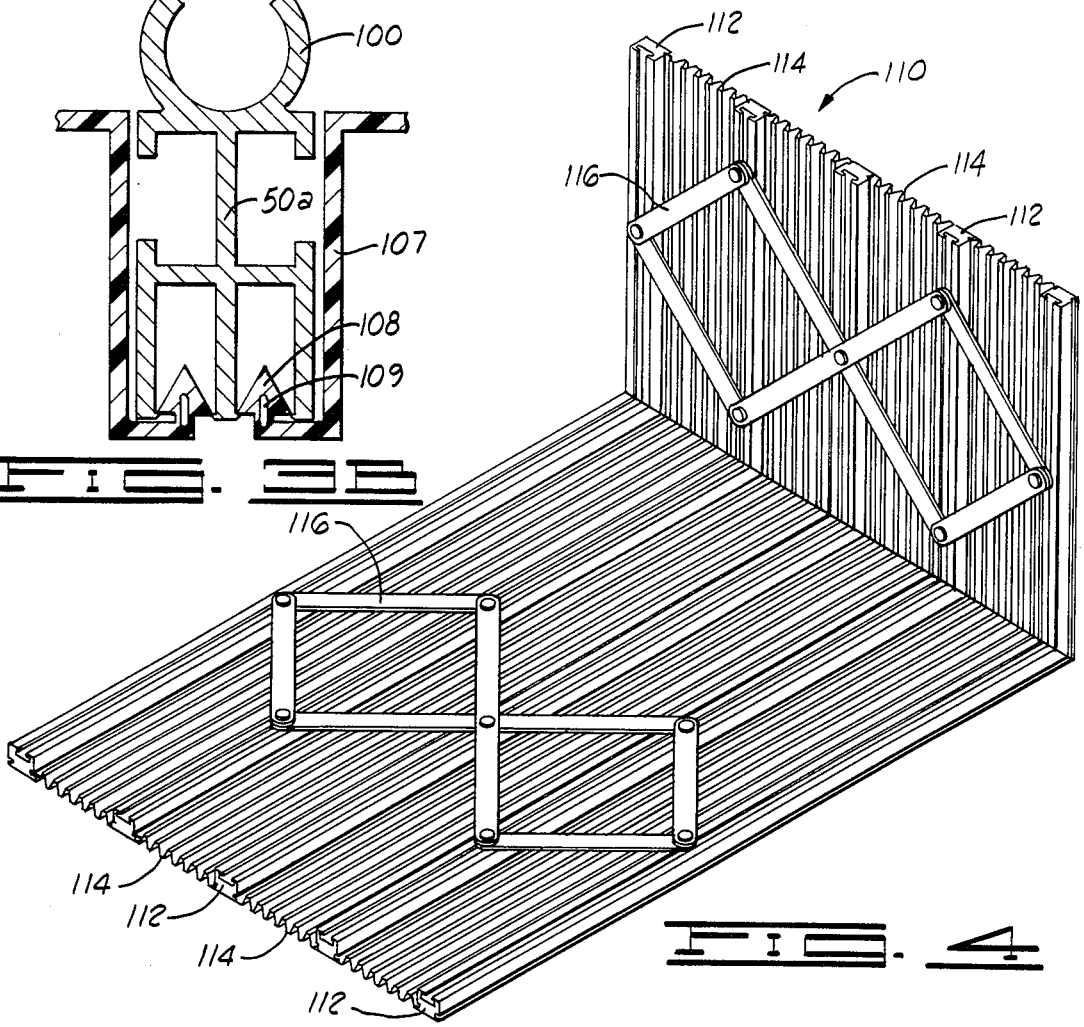
FIG. 4

WIDE EXTENSION EXPANSION JOINT ASSEMBLY

BACKGROUND OF THE INVENTION

1. Field of the Invention

The invention relates generally to expansion joint assemblies for interior and exterior building voids and, more particularly, but not by way of limitation, it relates to an improved form of expansion joint assembly for usage in expansion voids of relatively wide variance spacing that utilizes a novel centering structure.

2. Description of the Prior Art

The prior art includes numerous types of expansion joint assemblies for both interior and exterior application which include various kinds of expansion plate in combination with diverse types of support and centering structure. A representative type of expansion joint assembly with centering bar is represented by U.S. Pat. No. 3,183,626 in the name of Schmitt, a type of assembly that has enjoyed popular application for a long number of years. The Schmitt structure utilizes a centering bar that is centrally, pivotally fixed to the expansion assembly while having the ends ball-supported in adjacent slideways on opposite sides of the expansion void. U.S. Pat. No. 3,797,952 discloses a roadway expansion joint that utilizes a series of hinged lazy tong assemblies, pivotally fixed on a four-corner scheme, to support individual intermediate bars movably thereby to provide an expandable roadway support. In this case, each lazy tong upper hinge also supports an elongated intermediate bar which serves as traffic support across the expansion void.

U.S. Pat. No. 3,648,423 in the name of Cole discloses another form of expansion joint assembly, a flush mount device, which includes a lazy tong centering arrangement in addition to a spring retaining member and resilient seating structure. The expansion joint assembly, as proposed for adjoining panels of floor, wall, ceiling or the like, forms an elongated assembly having a plurality of spaced lazy tong centering linkages intersticed with a plurality of leaf spring devices for maintaining the expansion joint assembly in secure flush mount within said expanding surfaces. This structure is designed for recessed mount to provide smooth or generally planar exterior surface, and as such it is limited to much more narrow width expansion voids.

SUMMARY OF THE INVENTION

The present invention relates to improvements in construction of expansion joint assemblies suitable for use in interior or exterior applications that present larger expansion voids. The invention includes alternative forms of cover structure as employed with lazy tong centering structure for maintaining proper, centered positioning of the cover structure relative to the expansion void. Thus, the centering structure may be employed with bellows panel structure that is butt positioned across an expansion void and such bellows cover panel may be employed variously at different angular relationships. The similar type of centering structure may also be utilized with other flush mounted expansion joint cover assemblies of either the multi-plate or single plate cover type, and various forms of side rail extrusion may be included.

Therefore, it is an object of the present invention to provide an expansion void cover assembly that is capable of greater expansion limits variance while maintaining desirable aesthetic effects.

It is also an object of the present invention to provide an expansion joint cover assembly centering structure that is free of twisting and binding conditions that may affect the lay of the cover assembly.

It is still further an object of the present invention to provide a wide expansion limit cover assembly that is versatile as to its application in either indoor or exterior environment.

It is also an object of the invention to provide a multi-plate cover panel assembly that presents reduced exposed surface.

Finally, it is an object of the present invention to provide an expansion assembly and fixtures that enable any of butt mount, flush mount and other interior and exterior configuration mountings in structurally reliable manner while still allowing for orthogonal movement between adjoining structures.

Other objects and advantages of the invention will be evident from the following detailed description when read in conjunction with the accompanying drawings which illustrate the invention.

BRIEF DESCRIPTION OF THE DRAWINGS

FIG. 3A is a sectional view of an alternative form of support extrusion;

FIG. 3B illustrates the extrusion of FIG. 3A in combination with an alternative form of panel affixure bead;

FIG. 4 is a perspective view of the rear side of angularly adjoining expansion assemblies;

DETAILED DESCRIPTION OF THE INVENTION

Figure 1:
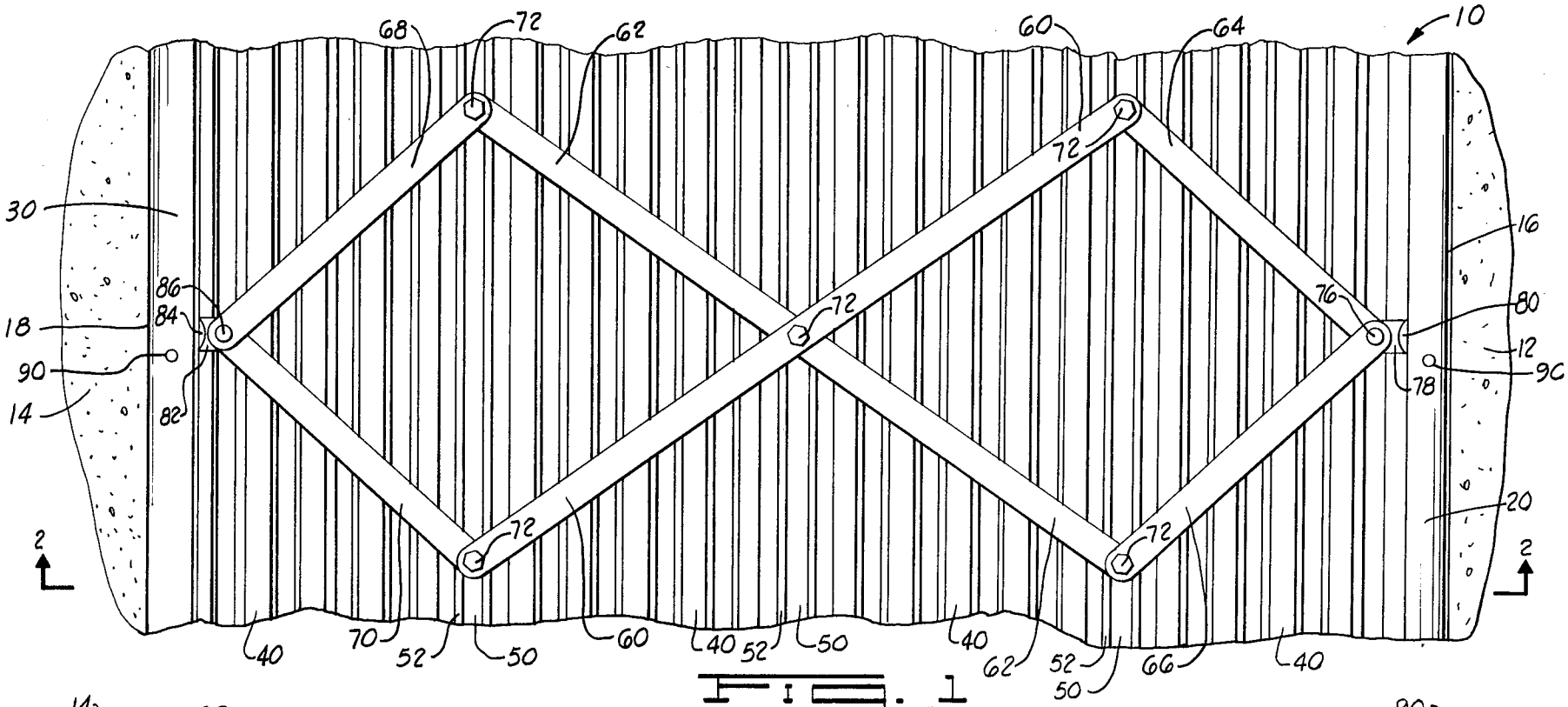
FIG. 1 is a plan view of a portion of the rear side of an expansion assembly constructed in accordance with the present invention.
Figure 2:
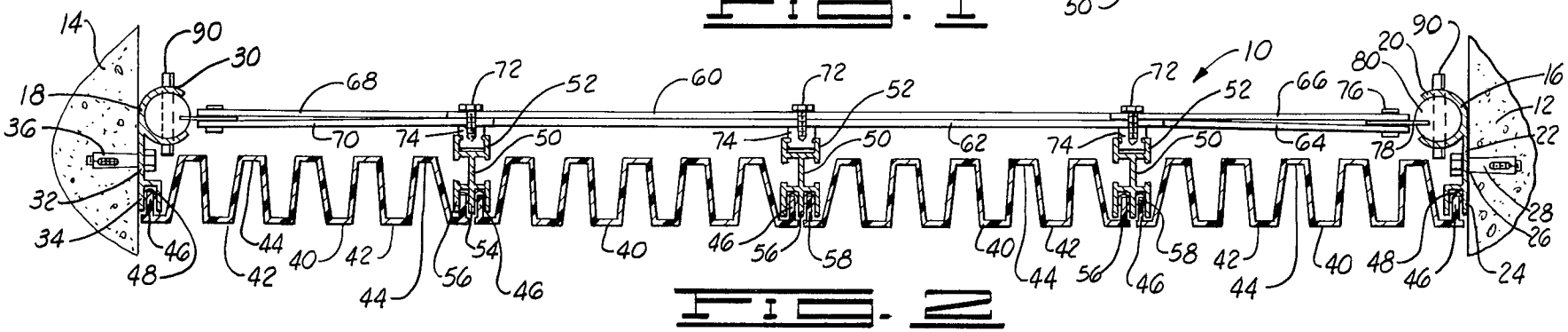
FIG. 2 is a cross-section along lines 2—2 of FIG. 1.

FIGS. 1 and 2 illustrate a large void expansion assembly 10 as installed in a void between opposite side structures 12 and 14. The opposite side structures 12 and 14 may be adjoining buildings, adjacent horizontal or vertical building structures, or interior wall, ceiling or floor structures. The expansion assembly 10 is the type which is particularly desirable for covering large variance expansion voids while still presenting a selected, desirable aesthetic appearance. Such expansion voids, particularly as may be existent between very tall building structures, may be required to tolerate expansion variance between as much as 15 to 40 inches, and the present design is capable of use in closing even larger voids.

As shown in FIG. 2, the opposite sides of the assembly 10 are supported by oppositely exposed side extrusions 16 and 18. The side extrusion 16 is formed lineally to include a ball-guide or channel 20 of circular cross-section, a planar mounting portion 22 and U-channel 24 in unitary formation. The mounting portion 22 is formed with a plurality of spaced holes 26 for receiving masonry fasteners 28. The opposite side extrusion 18 is similarly formed but in mirror image as the extrusion includes a unitary formation of ball guide channel 30, mounting portion 32 and U-channel 34 as secured to the building structure 14 by a plurality of masonry fasteners 36.

The front portion of assembly 10, that which is viewed and must carry the aesthetic effect, may be made up of such as a plurality of expansible panel members or bellows panels 40. The bellows panels 40 are preferably laid up in equal widths, formed from a resilient or pliable material such as light metal, elastomer or other plastic and formed with an equal number of folds or lands 42 and intersticed grooves 44. Present forms of bellows panel are commercially available in vinyl or neoprene material in selective land/groove size and number, and in various forms of color and texture. Each opposite side of panels 40 is formed with an in-turned securing lip 46 having a planar or spearhead form and suitable for securing as by clip, screw or other fastener. For example, the respective lips 46 of the outer bellows panels 40 are secured by insertion with a known type of Tinnerman fastener 48 within U-channels 24 and 34.

Inner support for bellows panels 40 is provided by a plurality of guide extrusions 50. The guide extrusions 50 are each lineally formed unitarily to include an inward facing guide channel 52 and an oppositely facing double U-channel 54 which carries dual, adjacent receiving slots 56 and 58. Each of channel slots 56 and 58 is adapted to receive such as a Tinnerman fastener 48 securing a bellows panel lip 46 therein.

An ordered and equal-displacement expansion and contraction of assembly 10 and the plurality of bellows panels 40 is effected by the lazy tong centering structure consisting of cross-links 60 and 62 and side links 64, 66, 68 and 70. The cross-links 60 and 62 are pivotally secured at their center by means of fastener 72 as secured within a guide block 74 (see FIG. 2). The guide block 74 includes channel configuration to enable locked, sliding configuration within guide channel 52 of center guide extrusion 50. Center link 60 is pivotally secured with side link 64 by a fastener 72 and a guide block 74 as is the other center link 62 and side link 66. The side links 64 and 66 are then again pivotally secured as by a pivot fastener 76 to a tab 78 that is rigidedly connected to a ball 80 as slidingly engaged within ball guide channel 20.

The opposite side of assembly 10 is similarly secured as the centering structure is slidingly engaged in ball channel 30. Thus, center links 60 and 62 are each pivotally secured by fastener 72 to side links 68 and 70, respectively, as fasteners 72 are each secured in respective guide blocks 74 as slidingly secured within a guide channel 52 of extrusion 50. The side links 68 and 70 are pivotally secured to a tab 82 and ball 84 by a pivot fastener 86 as ball 84 is slidingly engaged within ball guide channel 30. Balls 80 and 84 as well as guide blocks 74 may be formed from resilient plastic to increase slidability.

In use of an expansion assembly 10, an odd number of guide extrusions will be utilized in equi-spaced disposition across the void in cooperation with the side extrusions 16 and 18. The number of guide extrusions 50 may vary in accordance with the size of variance of the void as well as with the selection of cover or panel members such as bellows panels 40. In many applications, the assembly 10 will be laid up in a long vertical series of expansion assembly sections, e.g. 10 foot, 12 foot or larger selected lengths, and in such cases periodically disposed safety pins 90 (see FIG. 2) may be disposed in locking insert through the opposite side ball guide channels 20 and 30. Pins 90 serve as a safety lock to prevent vertical travel of the panel members due to accumulated loading and downslide of one or more sections of the assembly.

Thus, the assembly 10 is capable of orthogonal movement as expansion of the bellows panel 40 accommodates variance in lateral spacing between structures 12 and 14. Suspension of the panel 40 within ball guide channels 20 and 30 then further allow for uneven vertical movement as between structures 12 and 14 as well as for rotational movement, i.e. movement of panel 40 about the longitudinal axes of ball guide channels 20 and/or 30.

FIG. 3A illustrates an alternative form of guide extrusion **50*a*. The extrusion 50*a* includes the double U-channel 54 having locking channels 56 and 58 just as extrusion 50 of FIG. 2. However, the upper portion of guide extrusion 50*a* includes an elongated ball-channel 100 for carrying a ball guide 102 in sliding engagement. The ball guide 102 may be unitarily formed to include a neck 104 that extends a bolt end 106 for receiving nut fastener 72 as it pivotally secures lazy tong links e.g. 60, 62. Use of the ball-type guide 102 and channel 100 lessens possibilities of binding of the lazy tong centering structure under unusual or uneven stresses. FIG. 3B illustrates the similar extrusion 50*a* as it may be utilized to grip a panel 107 having a spearhead bead 108. Spearhead bead 108 includes a hollow portion 109** that allows collapse during insertion.

Figure 5:
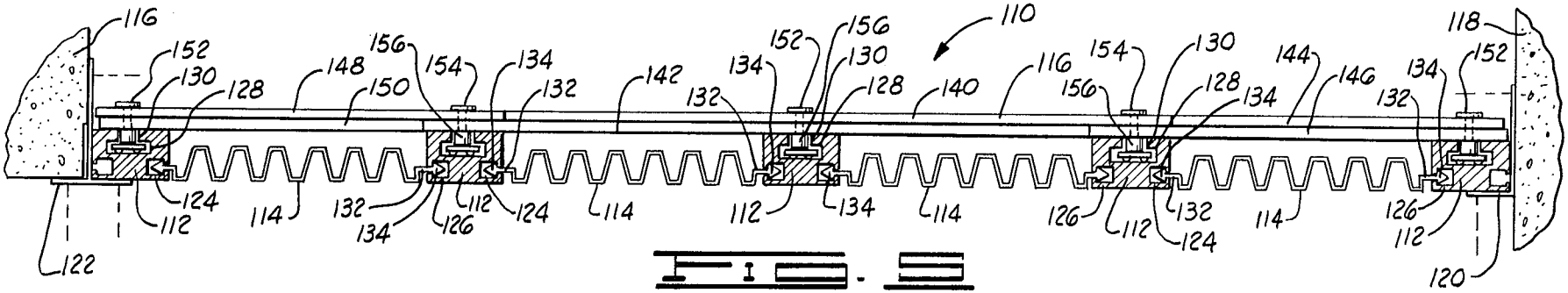
FIG. 5 is a view in cross-section of another form of expansion cover assembly for butt joinder across a void.

FIGS. 4 and 5 illustrate yet another form of expansion assembly with lazy tong centering wherein individual components are further standardized. The expansion assembly 110 utilizes a plurality of identical types of guide extrusions 112 supporting a plurality of bellows-type panels 114 as supported between respective pairs of guide bars 112. The standardized structure is readily adaptable for use in diverse planes or angular relationships as shown, and a spaced plurality of lazy tong assemblies 116 are disposed to maintain proper centering and uniform expansion of the aggregate bellows structure.

FIG. 5 illustrates the expansion joint assembly 110 with attention to greater detail. Expansion assembly 110 is secured between the adjoining building structures, walls, floors or the like 116 and 118 as supported by opposite side brackets 120 and 122, secured as along the dash-line indications. Bracket 120 is shown as an L-shaped bracket suitable for butt joinder use on a flat wall expanse, and bracket 122 is shown as a T-type bracket suitable for corner affixure. Each of guide extrusions 112 is an identical form of unitary extrusion which include opposite side bead grooves 124 and 126 and a centrally aligned guide channel 128 formed continuously within a narrower access groove 130. In this case, the panel members 114 of expansible type, a commercially available form, are formed with lateral tabs 132 having a compressible bead 134 formed thereon. Thus, each section of panel member 114 is secured by force fitting opposite side beads 134 into the respective bead retainer grooves 124 and 126 of adjacent side guide extrusions 112. The opposite sides of assembly 110 and outer guide extrusions 112 are then secured as by brackets 120, 122 to the adjacent building structures.

The centering bar structure or lazy tong member 116 is secured to the panel structure as each pivotal point of lazy tong member 116 is slidingly secured within the guide channel 128 in sliding engagement. Thus, and similar to the lazy tong mounting of FIG. 1, each of center links 140 and 142 and side link pairs 144, 146 and 148, 150 are pivotally secured at their respective pivot points by means of pivot fasteners 152. Each of pivot fasteners 152 may consist of such as a pivot screw 154 extending through respective link members for affixure in an inverted T-shaped resilient button 156, e.g. nylon, teflon or the like, which slides incapture within the guide channel 128 of the respective guide member 112.

The assembly of FIG. 5 is one directed to uniformity and standardization of components and the number of panel members 114 and guide extrusions 112 will be dictated by the size of the expansion void where applied. While the standard form as illustrated here employs five vertical guide members 112 with the central pivoting lazy tong arrangement (as shown in FIG. 4), it should be understood that a greater or lesser number of pivot linkages may be employed as required by the exigencies of each application. For example, the lazy tong centering can be employed with any combination of three or more vertical guide members to maintain equal spacing during expansion and contraction of the facing member.

Figure 6:
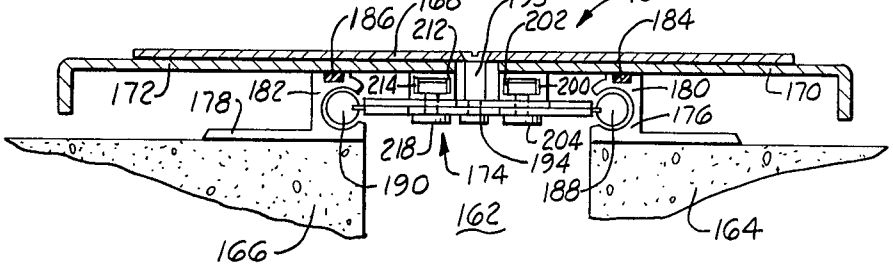
FIG. 6 is a sectional view of a multi-plate expansion assembly at the closed limits.
Figure 7:
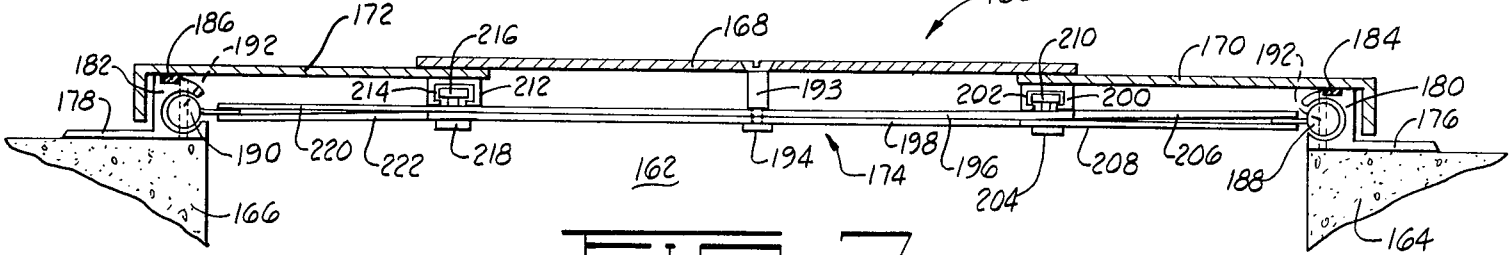
FIG. 7 is a sectional view of the assembly of FIG. 6 at the open limits.

FIG. 6 illustrates an alternative form of expansion assembly 160 as disposed to cover an expansion void 162 between adjoining structures 164 and 166. FIG. 6 shows assembly 160 at its closed or narrowest limits while FIG. 7 illustrates the outer limit configuration. Expansion assembly 160 utilizes a hard plate cover consisting of a center plate 168 and opposite side plates 170 and 172 as retained by a lazy tong assembly 174 sliding within opposite side ball extrusions 176 and 178.

The ball extrusion 176 and 178 are each formed with a mounting member and a respective ball guide channel 180 and 182. An outer portion of ball guide 180 is formed with a lineal recess wherein a resilient wiper material 184 is reposed. In like manner, a groove and insert material 186 is formed along ball guide channel 182. The plastic inserts 184 and 186 serve to form a wiper surface for sealing and weatherproofing adjacent the innerside of cover side plates 170 and 172. The respective opposite side guide balls 188 and 190 of lazy tong assembly 174 ride within respective ball channels 180 and 182. Safety pins 192 may be disposed periodically along ball guide channels in non-interfering positions as desired in order to support accumulated vertical loading.

The lazy tong assembly 174 expansibily retains the cover plate assembly thereover as the central cover plate 168 is secured by a pivot post 193 and pivot pin 194 through the center most pivot position of the lazy tong assembly 174, i.e. pivotally retaining center links 196 and 198. The side cover plate 170 includes an elongate guide member 200 defining a channel 202. Guide member 200 may be secured as by welding or the like to the backside of side cover plate 170 adjacent its inner extremity. A plurality of pivot pins 204, pivotally securing center links 196 and 198 with respective side links 206 and 208, are screw-fastened or the like within a slidable retainer nut 210 sliding incapture within channel 202. Thus, the side cover plate 170 is retained from pivot pin 204 through guide member 200 against resilient wiper element 184. The opposite side cover plate 172 is similarly constructed with an elongated guide member 212 defining a guide channel 214 for retaining a guide nut 216 that is rotatably secured by means of pivot pin 128 through the respective scissor linkages of center links 196, 198 with side links 220, 222.

Thus, the assembly 160 provides an expansible cover plate wherein all support structure as affixed to the building structures is concealed. Each of cover side plates 170 and 172 may be formed with a bend or wraparound on the outer edge to effect most fully such concealment of the inner support and centering structure. FIG. 6 illustrates the narrow limits of building structures 164 and 166 with side plates 170 and 172 nearly drawn beneath the cover plate 168. It can readily be seen in FIG. 6 that the lazy tong centering assembly 174 is contracted to approach its narrowest limits. FIG. 7 then illustrates the full extension limit of building structures 164 and 166 as the concealing cover structure, cover plates 168, 170 and 172, is fully expanded while still presenting a continuous outward appearance, and the lazy tong centering assembly 174 is also expanded to approach its full limits. It should always be understood that engineering tolerances can be provided in accordance with the particular sway or movement limits to be encountered.

Figure 8:
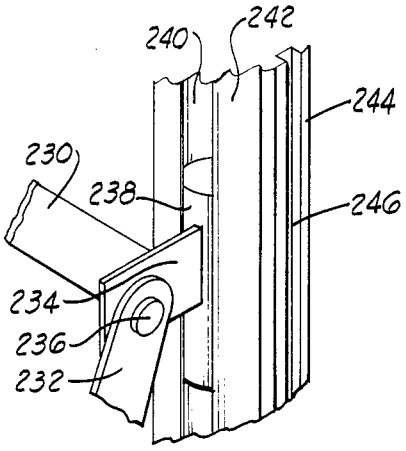
FIG. 8 is a perspective view of an alternative form of centering slide structure.

FIG. 8 illustrates an alternative form of centering guide assembly. Lazy tong side links 230 and 232 are pivotally connected to tab 234 by means of a pivot pin 236, and tab 234 is connected as by integral molding or welding with a cylindrical slide 238 riding within round channel 240 of guide member 242. The side guide member 242 may be similar to those of FIGS. 6 and 7 such that they carry an additional channel formation 244 for retaining a resilient wiper strip 246. The cylindrical guide 238 may be formed of stainless steel or resilient plastic, such as nylon, and such structure tends to minimize binding across the expanse of expansion assembly.

Figure 9:
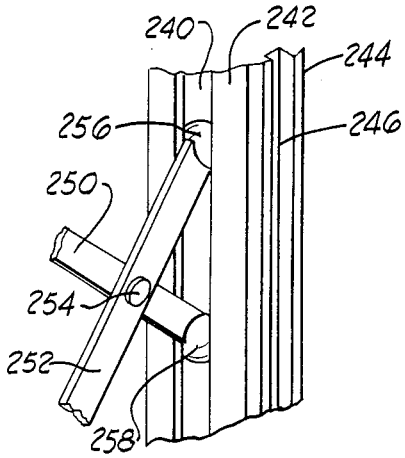
FIG. 9 is a perspective view of still another form of centering slide structure.

In like manner, the configuration of FIG. 9 may also be used to minimize the possibility of binding as between opposite sides of the centering assembly. In this case, the lazy tong side links 250 and 252 are pivotally linked by a pivot pin 254 proximate their outer ends, each of which carries an integrally formed, plastic molded ball 256 and 258, respectively, the balls 256 and 258 are then aligned to slide within the guide channel 240. The FIG. 9 structure also tends to elongate the contacting surfaces of the guide within the channel thereby to minimize the possibility of binding.

Figure 10:
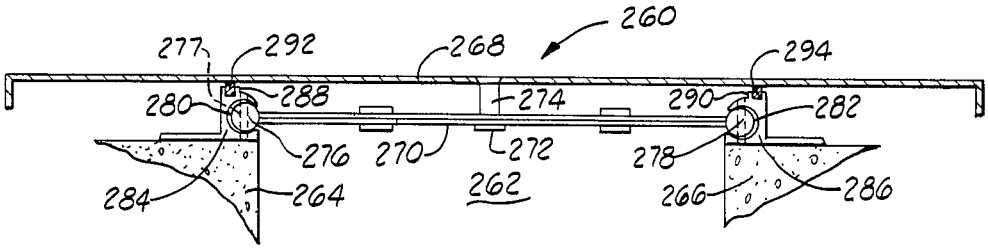
FIG. 10 is a cross-sectional view of a single plate expansion cover assembly; and, FIG. 11 is a partial rear view of a section of bellows cover assembly illustrating an alternative form of centering tong affixure for countering twist effects.

FIG. 10 illustrates yet another form of concealed cover plate expansion assembly 260 for closing a void 262 between building structures 264 and 266. In this case, a single cover plate 268 is utilized to cover the void space as it is supported by a designed plurality of lazy tong assemblies 270. Each lazy tong assembly 270 is affixed at its center pivot 272 to a securing stem 274 as affixed centrally to cover plate 268. The opposite guide balls or cylinders 276 and 278 are then coactively retained within mating guide channels 280 and 282 of respective side guide extrusions 284 and 286. The extrusions 284 and 286 may also include a suitable facing channel 288 and 290 for retaining resilient wiper strip 292 and 294 respectively. The assembly 260 in FIG. 10 is suitable for use in those applications where there is sufficient side clearance to enable full building structure expansion beneath the single facing cover plate 268.

Stop pins 277 secure against vertical travel from position.

Figure 11:
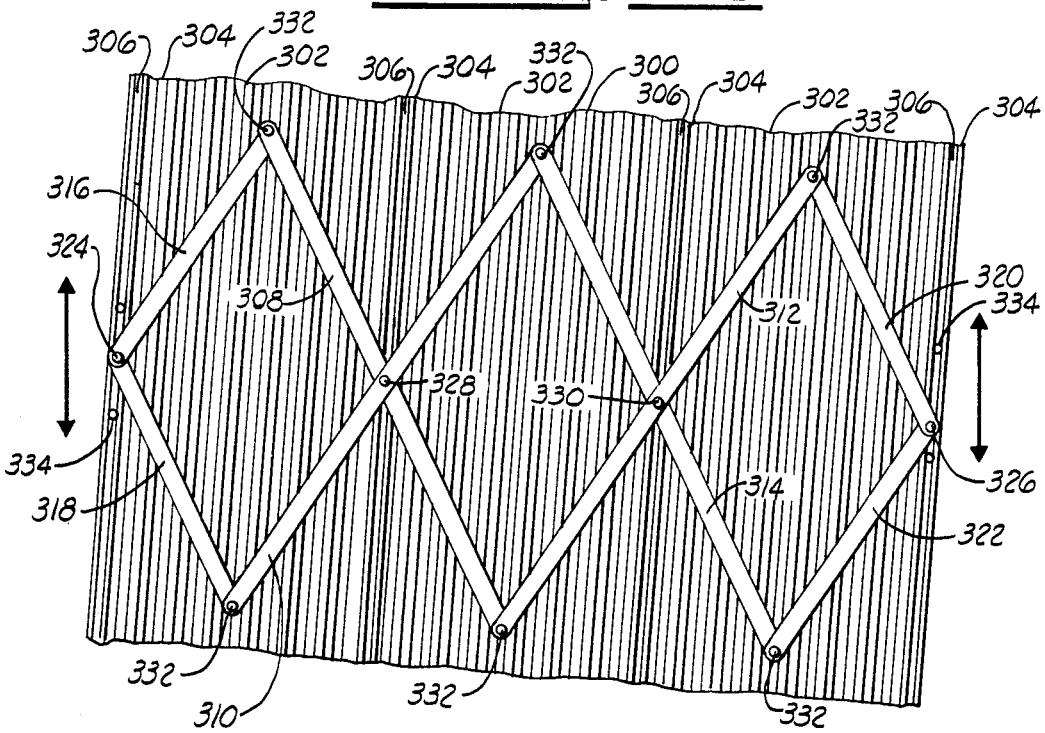

FIG. 11 illustrates yet another form of the lazy tong centering arrangement that utilizes a somewhat different combination of pivot positions. This design is particularly applicable to expansion situations wherein there is one primary expansion mode but also a significant orthogonal stress or movement which must also be encountered. The structure of FIG. 11 avoids undue binding of the lateral slide elements across the lazy tong assembly. Thus, the structure of FIG. 11 may be likened to that of FIG. 1 with the exception that intermediate pairs of tong link pivot points are allowed to ride free of guide contact with the cover panel.

More particularly, a cover panel 300 may consist of a plurality of bellows panels 302, each connected between respective guide extrusions 304 as by spearhead bead insertion, for example see FIG. 5. Each of the guide extrusions 304 includes a guide channel 306 for receiving sliding contact with the lazy tong assembly consisting of crossed center links 308, 310 and 312, 314 as interconnected between respective side link pairs 316, 318 and 320, 322.

Thus, side link pivot pins 324 and 326 slidingly ride within the guide channel 306 of respective side guide extrusion 304 in manner similar to that for FIG. 5, and cross link pivot pins 328 and 330 are also formed to be retained within a guide channel 306 of a respective intermediate guide extrusion 304; however, the remaining off-line pivot pins 332 merely serve to connect the respective lazy tong link connections pivotally without having contact with cover panel 300 possibly to cause binding. The heavy arrow designations are intended as an overemphasis to illustrate that while the lateral expansion of cover panel 300 is effected over an extended length, there can still be uneven movement in an orthogonal direction to cause a binding or buckling of the expansion assembly. In applications where this may occur, the linear lazy tong interconnection of FIG. 11 may be desirable. Safety pins 334 may be disposed to limit vertical movement from accumulated loading.

The foregoing illustrates novel expansion joint structure which is effective in concealing larger types of expansion void between building structures or adjoining wall or ceiling structures while maintaining strong and effective centering of the expansion assembly cover, and while enabling full presentation of those selected architectural materials providing best aesthetic effects. While various forms of alternative and combinations of specific structure have been specifically described, it should be understood that the particular designs of cover panel assembly, lazy tong centering structure and guide extrusion shape and mountings can be intermixed to provide a plurality of different forms of cover plate assembly offering the distinct advantages of the present invention.

Changes may be made in combination and arrangement of elements as heretofore set forth in the specification and shown in the drawings; it being understood that changes may be made in the embodiments disclosed without departing from the spirit and scope of the invention as defined in the following claims.

What is claimed is:

1. Apparatus for enclosing an expansion void between first and second building structures, comprising:

first and second elongate side extrusions each defining a respective guide channel along the length thereof, said side extrusions being secured in parallel on said first and second building structures;

cover means supported to extend laterally over said first and second side extrusions;

expansible multi-link lazy tong means centrally affixed to said cover means by pivotal connection to retain said cover means; and first and second guide means pivotally affixed on opposite sides of said lazy tong means and being slidably retained in said respective first and second side extrusion guide channels.

2. Apparatus as set forth in claim 1 which is further characterized to include:

at least one additional support connector pivotally and slidably connected between said cover means and lazy tong means in at least one position intermediate the cover means central pivotal connection and the proximate side extrusion.

3. Apparatus as set forth in claim 1 wherein said cover means comprises:

plural expansible panels having first and second opposite sides and being of similar size;

at least one intermediate guide extrusion defining a guide channel and securing means for affixure to respective first and second sides of laterally adjoining expansible panels; and plural slide means each pivotally connected to said lazy tong means at a selected position and each slidingly retained in one of said intermediate guide extrusion guide channels.

4. Apparatus as set forth in claim 2 wherein said cover means comprises:

plural expansible panels having first and second opposite sides and being of similar size;

plural intermediate guide extrusions each defining a guide channel and securing means for affixure to respective first and second sides of laterally adjoining expansible panels; and plural slide means each pivotally connected to said lazy tong means at a selected position and each slidingly retained in one of said intermediate guide extrusion guide channels.

5. Apparatus as set forth in claim 3 wherein said panels comprise:

bellows panels formed of pliable substance.

6. Apparatus as set forth in claim 3 wherein said intermediate guide extrusions comprise:

an elongate member defining on one side said guide channel for slidably retaining said slide means and defining on the opposite side at least one retaining groove for receiving and securing respective opposite sides of adjacent expansible panels.

7. Apparatus as set forth in claim 6 wherein:

said expansible panel opposite sides are formed with a compressible bead for force fit retention in said at least one retaining groove.

8. Apparatus as set forth in claim 7 wherein said panels comprise:

bellows panels formed of compliant material.

9. Apparatus as set forth in claim 1 wherein said lazy tong means comprises:

at least two pivotally cross-connected center links, the pivotal cross-connection being affixed centrally of said cover means while defining opposite pairs of center link ends; and first and second pairs of side links each pair being pivotally connected at one end to a respective one of said first and second guide means, and each pair having their remaining ends pivotally connected to a pair of center link ends.

10. Apparatus as set forth in claim 9 wherein:

said cross-connection is slidably affixed to said cover means.

11. Apparatus as set forth in claim 1 wherein said cover means comprises:

panel means of dimension greater than span of widest limits of the expansion void.

12. Apparatus as set forth in claim 11 which further includes:

first and second sealing strips affixed to each of said side extrusions for wiping contact with said panel means.

13. Apparatus as set forth in claim 11 wherein said lazy tong means comprises:

at least two pivotally cross-connected center links, the pivotal cross-connection being affixed centrally of said cover means while defining opposite pairs of center link ends; and first and second pairs of side links each pair being pivotally connected at one end to a respective one of said first and second guide means, and each pair having their remaining ends pivotally connected to a pair of center link ends.

14. Apparatus as set forth in claim 11 which is further characterized in that:

said first and second extrusion guide channels are circular in cross-section; and said first and second guides are similarly formed with slightly lesser radius.

15. Apparatus as set forth in claim 14 wherein:

said first and second guides are cylindrical.

16. Apparatus as set forth in claim 1 wherein said cover means comprises:

central panel means retained by being centrally pivotally affixed to said lazy tong means;

first and second side panels each slidably disposed in parallel with and behind said central panel means on each side thereof; and first and second pivot means secured to support respective first and second side panels by pivotal connection to said lazy tong means.

17. Apparatus as set forth in claim 16 wherein:

said first and second pivot means pivotal connection is slidably affixed to said lazy tong means.

18. Apparatus as set forth in claim 16 which further includes:

first and second sealing strips affixed to each of said side extrusions for wiping contact with said panel means.

19. Apparatus as set forth in claim 16 wherein said lazy tong means comprises:

at least two pivotally cross-connected center links, the pivotal cross-connection being affixed centrally of said cover means while defining opposite pairs of center link ends; and first and second pairs of side links each pair being pivotally connected at one end to a respective one of said first and second guide means, and each pair having their remaining ends pivotally connected to a pair of center link ends.

* * * * *